United States Patent [19]

Stahlecker et al.

[11] Patent Number: 4,763,469

[45] Date of Patent: Aug. 16, 1988

[54] OPEN-END ROTOR SPINNING ARRANGEMENT

[76] Inventors: Fritz Stahlecker, Josef-Neidhart-Strasse, 7347 Bad Überkingen; Hans Stahlecker, Hadlenstrasse 20, 7334 Süssen, both of Fed. Rep. of Germany

[21] Appl. No.: 67,873

[22] Filed: Jun. 30, 1987

[30] Foreign Application Priority Data

Jul. 4, 1986 [DE] Fed. Rep. of Germany ..... 3622523

[51] Int. Cl.[4] ..... D01H 1/135; D01H 1/241; D01H 7/08

[52] U.S. Cl. ..... 57/407; 57/105; 57/406

[58] Field of Search ..... 57/406, 407, 92, 1, 57/400, 404, 104, 105

[56] References Cited

U.S. PATENT DOCUMENTS 3,662,532 5/1972 Stahlecker ..... 57/406 X
3,793,820 2/1974 Rajnoha et al. ..... 57/406
3,805,506 4/1974 Stahlecker ..... 57/406 X
3,838,560 10/1974 Stahlecker ..... 57/406

FOREIGN PATENT DOCUMENTS 2833134 2/1980 Fed. Rep. of Germany .
3247411 6/1984 Fed. Rep. of Germany .

*Primary Examiner*—John Petrakes
*Attorney, Agent, or Firm*—Barnes & Thornburg

[57] ABSTRACT

An apparatus for open-end rotor spinning is provided which includes a spinning rotor having a rotor shaft and a spinning rotor plate on one end of the rotor shaft. At least one pair of supporting disks is provided in between which the rotor shaft is disposed. The supporting disks are disposed in a bearing block. A step bearing element is provided which supports the rotor shaft in axial direction on an end opposite the rotor blade. The step bearing element is mounted at the bearing block. A rotor housing element surrounds the rotor plate. The rotor housing element is held and centered directly at the bearing block. The bearing block serves as a carrying element for the step bearing element and the rotor element.

22 Claims, 2 Drawing Sheets

OPEN-END ROTOR SPINNING ARRANGEMENT

BACKGROUND AND SUMMARY OF THE INVENTION

The invention relates to an open-end rotor spinning arrangement having a spinning rotor that has a shaft that is disposed in a wedge-shaped gap formed by two pairs of supporting disks. The shaft is supported in axial direction at a step bearing and is driven by a tangential belt. The shaft carries a rotor (rotor plate) that is surrounded by a rotor housing, and the supporting disks are disposed in a bearing block at which a step bearing housing of the step bearing is mounted. The shaft, with respect to the step bearing housing and the rotor housing, is sealed off by a sealing element.

In a known open-end rotor spinning arrangement, German Unexamined Patent Application DE-OS No. 28 33 134, relatively large dimensions are required in longitudinal direction of the shaft of the spinning rotor. In the case of this construction, a bearing block is provided that is delimited by two flanges between which the pairs of supporting disks are arranged. The supporting disks of the pairs of supporting disks are offset with respect to one another in axial direction so that a distance is obtained between the flanges that amounts to at least four times the width of the supporting disks plus the dimension of the tangential belt or of a tension roller stressing the tangential belt. In the case of the known construction, the bearing block is carried by a rotor housing to which one of the flanges is screwed. A step bearing housing is fastened at the other flange.

In another known construction, German Unexamined Patent Application DE-OS No. 32 47 411, the step bearing housing is fastened at the bearing block via arms that reach around the supporting disks in a fork-shaped way. The bearing block itself is held at parts of the machine frame. In this construction, the rotor housing is mounted at the machine frame independently of the bearing block.

An object of the invention is to provide an open-end rotor spinning arrangement of the initially mentioned type in such a way that it is suitable for very high rotational speeds of the rotor, without the necessity of enlarging the dimensions, particularly of the shaft of the spinning rotor.

This object is achieved by holding and centering the rotor housing directly at the bearing block that serves as the carrying element for the step bearing housing and the rotor housing.

This arrangement is based on the recognition that the critical rotational speed of the spinning rotor represents a significant limitation for the maximally possible rotational speed, and that this critical rotational speed can be increased without enlarging the diameter of the rotor shaft by developing the rotor shaft as short as possible. In order to achieve this short rotor shaft construction, a relatively short distance will exist between the rotor housing and the step bearing housing. Increasing critical rotational speed was discussed in commonly assigned U.S. patent application Ser. No. 909,945, filed Sept. 22, 1986, now U.S. Pat. No. 4,703,616, which addressed minimizing the distance between two pairs of supporting disks in an open-end spinning apparatus, including a braking element. U.S. patent application Ser. No. 909,945 is hereby incorporated by reference.

It is also provided that the effect of a vacuum existing in the rotor housing cannot extend into the area of the step bearing housing. Otherwise, lubricant that emerges from the step bearing housing in the form of mist or the like could be sucked into the rotor housing which would result in disturbances of the spinning process. Both the step bearing housing and the rotor housing are mounted directly at the bearing block of the supporting disks. Therefore, it is possible to provide sealing elements by which the rotor shaft is sealed off with respect to the step bearing housing and the rotor housing, with very narrow tolerances, because both parts are aligned and centered with respect to the bearing block.

In further advantageous features of certain preferred embodiments of the invention, it is provided that the step bearing housing is provided with a recess into which ring-shaped sealing elements are inserted that surround the shaft. In these embodiments, the sealing elements can be exchanged easily in the case of wear. In this case, it is also advantageous that, as a further development of the invention, at least one of the sealing elements is equipped with a sliding surface that surrounds the shaft at a narrow distance. This ensures that in the case of a possible wear of the coating of the supporting disks and a resulting shifting of the shaft, the latter can touch the sealing elements without destroying itself and/or the sealing elements.

In further advantageous features of certain preferred embodiments of the invention, it is provided that the bearing block is equipped with guiding elements on which the rotor housing is guided in vertical and horizontal direction. On these guiding elements, the rotor housing can be aligned very precisely. There is also the advantage of an easy mounting and demounting. In the case of certain advantageous embodiments, it is provided that the guiding elements have a web-type shape and extend in the direction of the rotor housing and in parallel to the shaft beyond the pair of supporting disks facing the rotor housing.

In further advantageous features of certain preferred embodiments of the invention, it is provided that the distance between the pairs of supporting disks in longitudinal direction of the shaft corresponds to about 0.65 to 0.85 times that a section length that the shaft has from the pair of supporting disks closest the rotor housing to the end of the shaft projecting into the step bearing housing.

Tests have shown that the critical rotational speed is largely independent of the contact pressure of the tangential belt and of the weight of the rotor and remains more or less constant, but depends very clearly on the distance of the supporting disks and the length of the shaft by which the shaft projects beyond the pair of supporting disks facing the step bearing housing. Tests show that probably an optimum with respect to the height of the critical rotational speed will exist when the mentioned ratio is about 0.75. In the case of a practical embodiment, particularly high critical rotational speeds were obtained, where the distance between the pairs of supporting disks amounts to about 50 mm, and the projection of the shaft, i.e., the length of the shaft from the pair of supporting disks facing the step bearing to its end, is 20 mm.

Other objects, advantages and novel features of the Present invention will become apparent from the following detailed description of the invention when considered in conjunction with the accompanying drawings.

DETAILED DESCRIPTION OF THE DRAWINGS

Figure 1:
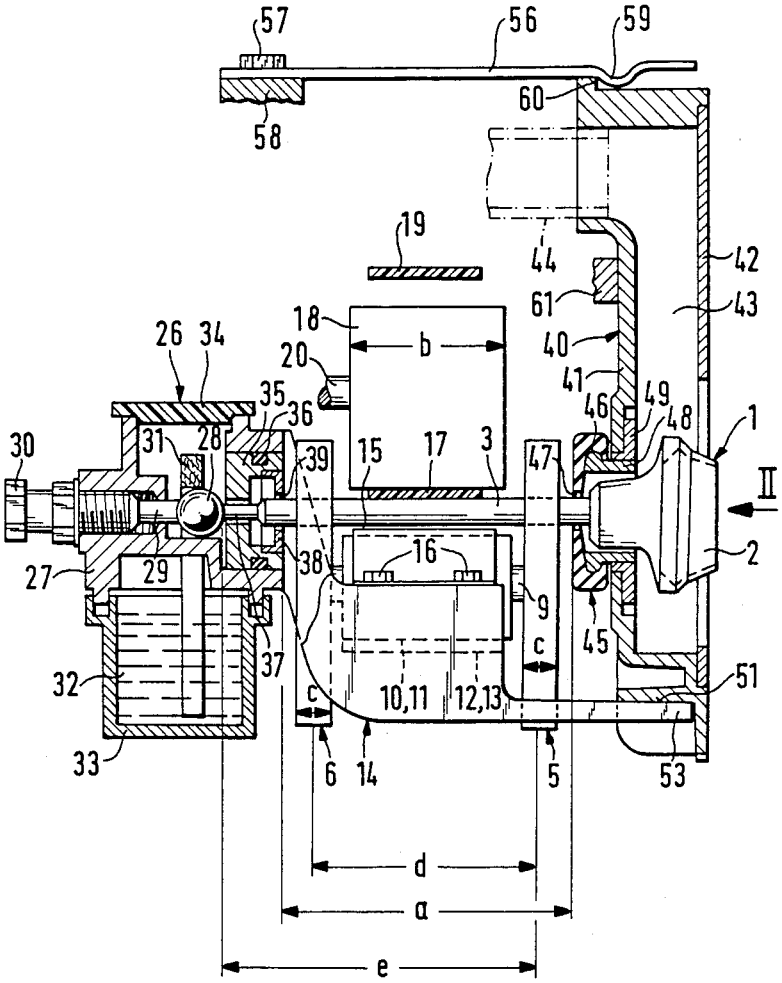
FIG. 1 is a partial cross-sectional lateral view (Line I—I of FIG. 2) of an open-end spinning machine according to a preferred embodiment of the invention.

The shown embodiment contains a spinning rotor assembly 1 including a rotor 2 and a shaft 3. The shaft 3 is disposed in the wedge-shaped gaps 4 of two pairs of supporting disks 5, 6. Each pair 5, 6 of supporting disks contains two supporting disks 7, 8 that in each case are opposite one another with respect to the shaft 3. In a way not shown in detail, the supporting disks 7, 8 are equipped with a fitting made of plastic at their circumferential surfaces. In a torsionally fixed way, the supporting disks 7, 8 are arranged on two shafts 9 that by means of roller bearings, are disposed in bearing housings 10, 11. The bearing housings 10, 11 are arranged in half-shell-shaped receiving elements 12, 13 of a bearing block 14. The bearing housings 10, 11 are held in the receiving elements 12, 13 by a bow-shaped tension element 15. The tension element 15 also has approximately half-shell-shaped recesses by which it reaches around the bearing housings 10, 11. The tension element 15 is fastened at the bearing block 14 by fastening screws 16.

The spinning rotor assembly 1 is driven by a tangential belt 17 that moves along in the center between the pairs of supporting disks 5, 6 against the shaft 3, and presses it into the wedge-shaped gaps 4. The tangential belt 17 moves in longitudinal direction through a spinning machine that is not shown which includes a plurality of the described spinning units and drives the shafts 3 of all spinning rotor assemblies 1 of these spinning units of at least one side of the machine. The tangential belt 17 is loaded by a tension roller 18 Pressed against the tangential belt 17 in proximity of the shaft 3 in the direction of the wedge-shaped gaps 4. The returning side 19 of the tangential belt 17 moves unloaded.

The tension roller 18 has a shaft 20 disposed freely, rotatably in a bearing 21' of a lever 21 that can be pivoted around a stationary axis 22 aimed parallel to the shaft 3. A leaf spring 23 acts on the lever 21. The leaf spring 23 is fastened at a stationary holding element 24 by a screw 25.

The end of the shaft 3 of the spinning rotor assembly 1 is supported in a step bearing 26. The step bearing 26 has a step bearing housing 27 that is equipped with two arms reaching around the pair 6 of supporting disks. The arms are formed onto the bearing block 14. In the step bearing housing 27, a freely rotatable step bearing ball 28 is disposed, at which the end of the shaft 3 is supported. The shaft 3 is loaded with a slight axial push that is generated because the axes 9 of the pairs 5, 6 of supporting disks are slightly crossed with respect to one another. On the side that is opposite the shaft 3, the ball 28 is supported by a pin 29 that is a component of an adjusting screw 30 that is screwed into the step bearing housing 27, and is secured by a counter nut. By adjusting the adjusting screw 30, the position of the step bearing ball 28 and thus also the position of the shaft 3 can be adjusted in axial direction. A wick 31 rests on the step bearing ball 28. The wick 31 is dipped into a lubricant bath 32. This lubricant bath 32 is located in a container 33 that is fastened at the underside of the step bearing housing 27.

In upward direction, the step bearing housing 27 is closed off by a removable cover 34. After the cover 34 is removed, a refilling of lubricant can take place.

The step bearing housing 27 is provided with a bore 39, via which the shaft 3 enters into the step bearing housing 27. In the area of this bore 39, a sealing-off of the step bearing housing 27 takes place with respect to the shaft 3 by a labyrinth seal. This labyrinth seal is formed by a ring-shaped insertion piece 35 that is sealed off with respect to the bore 39 of the step bearing housing 27 by a sealing means 36. This insertion piece 35 forms a cylindrical sliding surface 37 located a narrow distance of one millimeter or less outside the shaft 3. The shaft 3 is reduced in diameter in this area of its end. At least in the area of the cylindrical sliding surface 37, the insertion piece 35 is made of a material that has sliding characteristics and thus emergency moving characteristics for the shaft 3. A second sealing gap that has very narrow tolerances is formed by an additional bowl-type insertion 38 that is inserted into the insertion piece 35. The insertion 38 forms a bore with very narrow tolerances for the shaft 3 that has a thicker diameter in the area of the insertion 38 than in the area of the sliding surface 37. In certain preferred embodiments, the bowl-shaped insertion 38 is made as a drawn sheet-metal part. At least in the area of the bore for the shaft 3, the insertion 38 has a very narrow wall thickness so that an approximately knife-shaped sealing element is obtained. Between the cylindrical sliding surface 37 and the insertion 38, an expansion is located that serves as an air accumulation seal.

Figure 2:
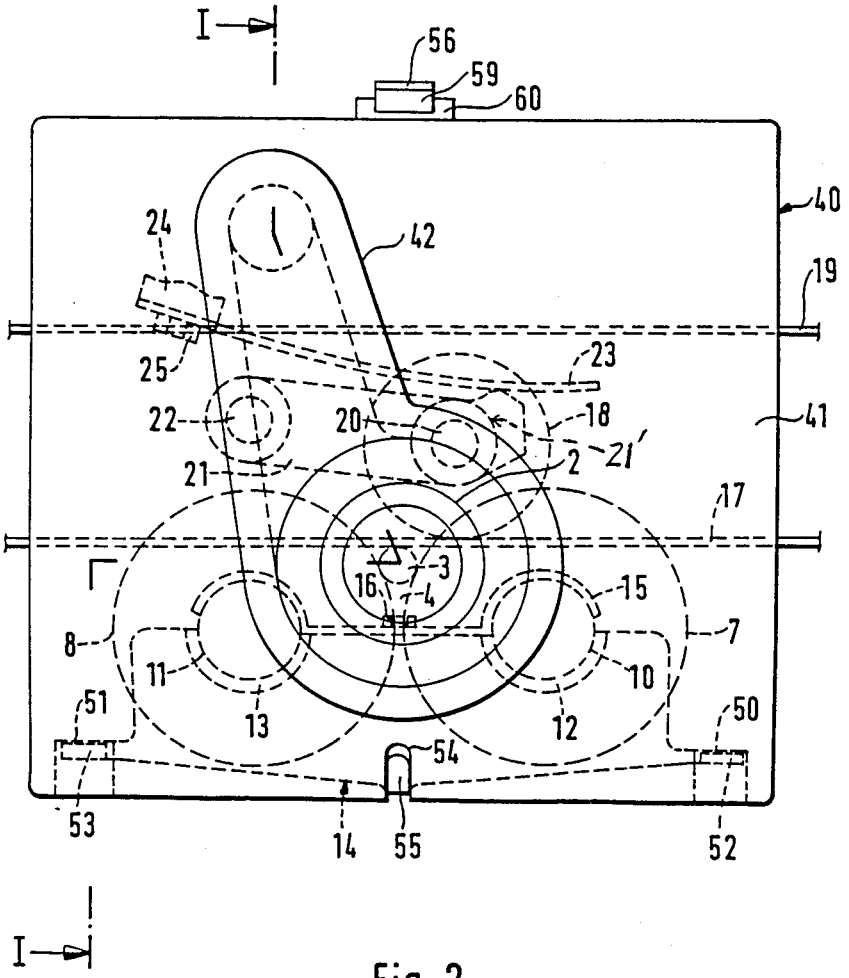
FIG. 2 is a view in the direction of the Arrow II of FIG. 1, in which case some structural components for reasons of representation are not shown.

The rotor 2 of the spinning rotor assembly 1 is surrounded by a rotor housing 40. The rotor housing 40 includes a cuboid basic housing 41 that is preferably made of plastic and a plate-shaped part 42 that is fastened at it and serves as a covering. In the area of the rotor 2, the basic housing 41 has a recess that, by means of a duct-shaped projection 43, extends into the area of a suction line 44 in FIG. 2 (indicated only by a dash-dotted line). The contour of the plate-shaped cover part 42 corresponds to the described projection 43. During the operation, the cover part 42 itself is closed by a cover that is not shown and that, in a known way, contains a fiber feeding duct and a yarn withdrawal duct that are assigned to the spinning rotor assembly 1.

The rotor housing 40 is sealed off with respect to the area of the pairs 5, 6 of the supporting disks by a sealing element 45. A metal shell 49 is inserted in the basic housing 41 that is held at the basic housing 41 by a radial flange. At this metal shell 49, a metal shell 48 is fastened that projects past the rear wall of the basic housing 41. A gasket 46 is clipped onto the metal shell 48. The gasket 46 has a disk-shaped area that is provided with a bore 47 for the leading-through of the shaft 3. The bore 47 encloses the shaft 3 almost without play.

The rotor housing 40 is held and centered directly at the bearing block 14. The bearing block 14 is equipped with three web-shaped guiding elements 52, 53, 55 that extend parallel to the shaft 3, and that are aimed at the rotor housing 40. The guiding elements 52, 53, 55 project over the pair 5 of supporting disks, and the underside of the basic housing 41 is supported on the guiding elements 52, 53, 55. The basic housing 41, by means of two fitting surfaces 50, 51, is supported on the two guiding elements 52, 53 that project laterally from the bearing block 14 toward the front. The two fitting surfaces 50, 51 cause a vertical support and laterally have play. By means of a central, slot-shaped fitting surface 54, the basic housing 41 is supported on the central guiding element 55 in transverse direction with respect to it, with a play being left in vertical direction. As an alternative, it may be provided to arrange the guiding element 55 and the assigned guiding surface 54 to one side of the basic housing 41, rather than in the center. By directly fastening the rotor housing 40 at the bearing block 14, it is achieved that the rotor housing 40, with respect to the shaft 3, is aligned precisely in radial direction, so that it is possible to develop the bore 47 of the gasket 46 with very narrow tolerances with respect to the shaft 3.

A mounting and demounting of the rotor housing 40 at the bearing block 14, that takes place when the spinning rotor assembly 1 is pulled out toward the front, is very easy to carry out because the rotor housing 40 with its fitting surfaces 50, 51, 54 must only be fitted from above onto the corresponding guiding elements 52, 53, 55 or be pulled off in upward direction. In the operating position, the rotor housing 40 with the basic housing 41 rests against a stationary stop 61. It is fixed in this Position, by a springy securing element in the form of a leaf spring 56. The leaf spring 56 is fixed at a stationary holding element 58 by a spring 57. The leaf spring 56 is equipped with a cam 59 that reaches behind a catch 60 of the rotor housing 40, for example, a catch of the basic housing 41, and thus fixes it against the stop 61. Additional stops and/or securing elements in axial direction of the rotor shaft 3 may also be provided by corresponding stops and counterstops in the area of the guiding elements 52, 53 and 55 of the bearing block 14 and/or of the fitting surfaces 50, 51, 54 of the rotor housing 40.

By using the arrangement according to the invention, it is possible to keep the distance (a) between the sealing element 45 of the rotor housing 40 and the step bearing housing 27 very short. This distance is determined essentially only by the width (b) of the tension roller 18 and the widths (c) of two supporting disks 7, 8, in which case, naturally, a tolerance play must be provided. In addition, the rotor housing 40 and thus the rotor 2 can be disposed very close to the pair 5 of supporting disks facing it. The distance (d) between the pairs 5, 6 of supporting disks, in addition, is related to the distance (e) between the pair 5 of supporting disks facing the rotor housing 40 and the end of the shaft 3 in such a way that it amounts to about 0.65 to 0.85 times the distance (e). As a result of these dimensions, it becomes possible to clearly increase the critical rotational speed of the spinning rotor 1 so that operational rotational speeds of up to 130,000 $min^{-1}$ are possible without difficulty. Further, using the invention, a very good sealing with respect to the rotor housing 40 and with respect to the step bearing housing 27 is obtained so that a reciprocal effect is largely excluded. In addition, the distance between the tangential belt 17 and the step bearing housing 27 is so small that in the area of the sealing element 38 an air current is generated by the tangential belt 17 that ensures that lubricant that may emerge from the step bearing housing 27 in the form of mist is prevented from entering the rotor housing 40.

From the preceding description of the preferred embodiments, it is evident that the objects of the invention are attained, and although the invention has been described and illustrated in detail, it is to be clearly understood that the same is by way of illustration and example only and is not to be taken by way of limitation. The spirit and scope of the invention are to be limited only by the terms of the appended claims.

What is claimed is:

1. Apparatus for open-end rotor spinning comprising:

a spinning rotor assembly including a rotor shaft and a spinning rotor on one end of the rotor shaft;

at least one pair of supporting disks in between which said rotor shaft is disposed;

at least one shaft on which each said supporting disk of said at least one pair of supporting disks is supported;

a bearing block on which said supporting disk shafts are disposed;

step bearing means for supporting said rotor shaft in axial direction on an end opposite said rotor; and rotor housing means for surrounding said rotor, said rotor housing means and said step bearing means being held and centered with respect to one another and said rotor shaft directly on said bearing block.

2. Apparatus as in claim 1, wherein said rotor shaft is disposed in a wedge-shaped gap formed between said at least one pair of supporting disks.

3. Apparatus as in claim 2, further comprising step bearing housing means for housing said step bearing means, said step bearing housing means being mounted on said bearing block.

4. Apparatus as in claim 3, wherein said step bearing housing means and said bearing block are one piece.

5. Apparatus as in claim 3, further comprising sealing means for sealing said rotor shaft with respect to said step bearing housing means.

6. Apparatus as in claim 5, wherein said step bearing housing means includes a recessed receiving means for receiving said sealing means, said sealing means including a ring-shaped sealing means inserted into said recessed receiving means and surrounding said rotor shaft.

7. Apparatus as in claim 6, wherein at least a portion of said sealing means include a sliding surface surrounding said rotor shaft at a narrow distance from said rotor shaft.

8. Apparatus as in claim 6, wherein said sealing means form a labyrinth seal that includes at least two sealing gaps around said rotor shaft in the direction of said rotor shaft.

9. Apparatus as in claim 3, wherein said rotor housing means includes a shaft bore through which said rotor shaft extends and said step bearing housing means includes a shaft bore through which said rotor shaft extends, said rotor housing shaft bore and said step bearing housing shaft bore being aligned along a common central axis.

10. Apparatus according to claim 9, further comprising:

step bearing sealing means for sealing said rotor shaft with respect to said step bearing housing means, said step bearing sealing means being disposed in said step bearing housing means shaft bore; and rotor housing sealing means for sealing said rotor shaft with respect to said rotor housing means, said rotor housing sealing means being disposed in said rotor housing means shaft bore.

11. Apparatus as in claim 10, wherein said step bearing means sealing means and said rotor housing sealing means comprise non-contact sealing means spaced around said rotor shaft a narrow distance from said rotor shaft.

12. Apparatus as in claim 2, further comprising rotor housing sealing means for sealing said rotor shaft with respect to said rotor housing means.

13. Apparatus as in claim 12, wherein said rotor housing sealing means include a shell fastened to said rotor housing means, said shell extending out of said rotor housing means from a point surrounding said rotor toward said rotor shaft, and a gasket attached to said shell, said gasket including a gasket bore through which said rotor shaft is disposed at a narrow distance from said rotor shaft.

14. Apparatus as in claim 2, wherein said bearing block includes guiding means for guiding said rotor housing means in a vertical and a horizontal direction.

15. Apparatus as in claim 14, wherein said apparatus includes a first pair of supporting disks closest to said rotor housing means and a second pair of supporting disks closest to said step bearing means.

16. Apparatus as in claim 15, wherein said guiding means include guiding elements having a web-shaped form and extending substantially parallel to said rotor shaft in the direction of said rotor housing means beyond the first pair of supporting disks.

17. Apparatus as in claim 2, wherein said apparatus includes a first pair of supporting disks closest to said rotor housing means and a second pair of supporting disks closest to said step bearing means.

18. Apparatus as in claim 17, wherein said first pair and said second pair of supporting disks include a distance therebetween in longitudinal direction of said shaft, said rotor shaft including a section length from said first pair of supporting disks to the end opposite the rotor, said distance between said two pairs of supporting disks being approximately 0.65 to 0.85 times said section length of said rotor shaft.

19. Apparatus as in claim 18, wherein the distance between the two pairs of supporting disks is approximately 50 mm and the section length of the rotor shaft is approximately 70 mm.

20. Apparatus as in claim 1, further comprising a tangential belt means for driving said rotor shaft.

21. Apparatus as in claim 1, wherein said rotor housing means is exchangeably mounted on said bearing block.

22. Apparatus as in claim 21, wherein said bearing block includes guiding means for guiding said rotor housing means in a vertical and a horizontal direction during mounting of said rotor housing means on said bearing block.

* * * * *